US010586665B2

(12) United States Patent
Esenwein et al.

(10) Patent No.: US 10,586,665 B2
(45) Date of Patent: Mar. 10, 2020

(54) ELECTRIC POWER TOOL

(71) Applicant: Robert Bosch GmbH, Stuttgart (DE)

(72) Inventors: Florian Esenwein, Leinfelden-Echterdingen (DE); Manfred Lutz, Filderstadt (DE); Achim Trick, Sielmingen (DE); Thomas Schomisch, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 344 days.

(21) Appl. No.: 15/500,147

(22) PCT Filed: May 5, 2015

(86) PCT No.: PCT/EP2015/059787
§ 371 (c)(1),
(2) Date: Jan. 30, 2017

(87) PCT Pub. No.: WO2016/015884
PCT Pub. Date: Feb. 4, 2016

(65) Prior Publication Data

US 2017/0250038 A1 Aug. 31, 2017

(30) Foreign Application Priority Data

Jul. 30, 2014 (DE) ..... 10 2014 214 982

(51) Int. Cl.
*H01H 21/10* (2006.01)
*B25F 5/00* (2006.01)
(Continued)

(52) U.S. Cl.
CPC ..... *H01H 21/10* (2013.01); *B24B 23/028* (2013.01); *B25F 5/00* (2013.01); *H01H 21/24* (2013.01);
(Continued)

(58) Field of Classification Search
CPC ..... H01H 2235/01; H01H 9/06; H01H 21/24; H01H 21/36; H01H 21/10; B25F 5/00; B24B 23/028
(Continued)

(56) References Cited

U.S. PATENT DOCUMENTS 7,722,444 B2 * 5/2010 Gallagher ..... B24B 23/022 451/344
9,123,478 B2 * 9/2015 Esenwein ..... H01H 9/00
(Continued)

FOREIGN PATENT DOCUMENTS

CN 1476959 A 2/2004
CN 102171005 A 8/2011
(Continued)

OTHER PUBLICATIONS

International Search Report corresponding to PCT Application No. PCT/EP2015/059787, dated Aug. 12, 2015 (German and English language document) (7 pages).

*Primary Examiner* — Robert F Long
*Assistant Examiner* — Xavier A Madison
(74) *Attorney, Agent, or Firm* — Maginot, Moore & Beck LLP

(57) ABSTRACT

An electric power tool has a tool receptacle and a tool housing in which a drive motor for driving the tool receptacle is arranged. The drive motor is switchable on and off via an electric switch. An operating part for indirectly actuating the switch is arranged on the tool housing and extends approximately parallel to a longitudinal axis of the tool housing. The operating part is lever-like and is pivotably arranged on the tool housing. An actuating member of the switch is displaceable approximately parallel to the longitudinal axis by an actuating force that acts on the operating part approximately perpendicularly to the longitudinal axis. The drive motor is switched on by the actuating force acting
(Continued)

on the operating part against a restoring force of the switch, and the drive motor is switched off automatically, via the restoring force, when the operating part is released by a user.

16 Claims, 13 Drawing Sheets

(51) Int. Cl.

| | |
|---|---|
| ***B24B 23/02*** | (2006.01) |
| ***H01H 21/24*** | (2006.01) |
| ***H01H 21/36*** | (2006.01) |
| *H01H 9/06* | (2006.01) |

(52) U.S. Cl.
CPC ..... *H01H 21/36* (2013.01); *H01H 9/06* (2013.01); *H01H 2235/01* (2013.01)

(58) Field of Classification Search
USPC ..... 173/1–11, 18–19, 141–161, 170
See application file for complete search history.

(56) References Cited

U.S. PATENT DOCUMENTS

| | | | | |
|---|---|---|---|---|
| 2003/0190877 | A1* | 10/2003 | Gallagher | B24B 23/02 451/344 |
| 2009/0145520 | A1 | 6/2009 | Opsitos, Jr. et al. | |
| 2011/0057014 | A1* | 3/2011 | Yang | B25C 1/008 227/8 |
| 2013/0140051 | A1* | 6/2013 | Rudolph | B25F 5/00 173/18 |

FOREIGN PATENT DOCUMENTS

| | | | |
|---|---|---|---|
| CN | 102189533 | A | 9/2011 |
| DE | 20 2011 108 753 | U1 | 3/2012 |
| EP | 1 327 497 | A2 | 7/2003 |
| EP | 2 365 502 | A1 | 9/2011 |
| EP | 2 422 934 | A1 | 2/2012 |
| JP | H01-160637 | U | 11/1989 |
| JP | H01-164630 | U | 11/1989 |
| JP | H03-283326 | A | 12/1991 |
| JP | H08-112761 | A | 5/1996 |
| JP | 2001-176350 | A | 6/2001 |
| JP | 2005-169588 | A | 6/2005 |
| JP | 2006-315172 | A | 11/2006 |
| JP | 2011-51044 | A | 3/2011 |

* cited by examiner

ELECTRIC POWER TOOL

This application is a 35 U.S.C. § 371 National Stage Application of PCT/EP2015/059787, filed on May 5, 2015, which claims the benefit of priority to Serial No. DE 10 2014 214 982.7, filed on Jul. 30, 2014 in Germany, the disclosures of which are incorporated herein by reference in their entireties.

BACKGROUND

The present disclosure relates to an electric power tool having a tool receptacle and a tool housing in which a drive motor for driving the tool receptacle is arranged, said drive motor being able to be switched on and off via an electric on/off switch, wherein an operating part for at least indirectly actuating the on/off switch is arranged on the tool housing, and the operating part at least regionally extends at least approximately parallel to a longitudinal axis of the tool housing.

Electric power tools of this kind, which are provided for example with a bar-shaped tool housing in which an associated electric drive motor is in each case arranged, are known from the prior art. In order to switch the drive motor on and off, an operating part is provided, for example, which is arranged, as a large-area, lever-like switch element or pawl, in the front region of the housing and by way of which an electric on/off switch assigned to the drive motor is actuated. In this case, the drive motor is switched on in that the pawl is pushed toward the tool housing by a user.

A disadvantage of the prior art is that, in the case of such electric power tools having a bar-shaped tool housing and a lever- or rocker-like operating part, an electric on/off switch having an actuating plunger that is oriented or actuable parallel to the housing longitudinal axis is usable only with increased structural outlay.

SUMMARY

Therefore, it is an object of the disclosure to provide a novel electric power tool having a tool housing in which an electric on/off switch that is actuable parallel to the housing longitudinal axis is actuable in a structurally simple manner with the aid of a lever- or rocker-like operating part, without there being a relevant change in its (standard) installation position within the tool housing.

This problem is solved by an electric power tool having a tool receptacle and a tool housing in which a drive motor for driving the tool receptacle is arranged, said drive motor being able to be switched on and off via an electric on/off switch, wherein an operating part for at least indirectly actuating the on/off switch is arranged on the tool housing, and the operating part at least regionally extends at least approximately parallel to a longitudinal axis of the tool housing. The operating part is configured in a lever-like manner and is arranged in a pivotable manner on the tool housing. An actuating member of the electric on/off switch is displaceable at least approximately parallel to the longitudinal axis by an actuating force that acts on the operating part at least approximately perpendicularly to the longitudinal axis, wherein the drive motor is able to be switched on by the action of the actuating force on the operating part counter to a restoring force of the electric on/off switch, and the drive motor is able to be switched off automatically by the operating part being released by a user, at least on account of the restoring force of the electric on/off switch.

On account of the lever-like configuration, in accordance with the disclosure, of the operating part, the latter can be actuated with little effort by the user, wherein, at the same time, fatigue-free holding down of the operating part provides convenient long-term usage and the drive motor switches off automatically if the operating part is released in a controlled or uncontrolled manner. For convenient operation by the user, the operating part preferably has a large-area, ergonomically designed actuating surface that faces away from the tool housing.

Preferably, a mechanical locking member for avoiding accidental actuation by a user is assigned to the operating part. As a result, the risk of personal injury and material damage during operation of the electric power tool is reduced.

Preferably, the operating part is pretensioned with respect to the tool housing by means of a return spring. The optional return spring supports the effect of a spring provided in the electric on/off switch and thus the automatic switching-off operation if the user releases the operating part.

According to one embodiment, the operating part is formed with a two-armed pawl which is received in a pivotable manner at a pivot point on the tool housing. As a result, the actuation of the operating part with a defined actuating force provides a smoother switching-on and switching-off operation. Furthermore, the lever- or rocker-like configuration allows the operating part to be held down permanently in a fatigue-free manner for continuous operation of the electric power tool.

Preferably, the two-armed pawl has a first and a second arm on either side of the pivot point. An angle between the two arms of the two-armed pawl is preferably in a range from 140° to 220°, preferably including the range limits. Thus, it is possible for a small overall height of the operating part in the radial direction to be realized. A variation in the length of the arms furthermore allows the transmission ratio of the two-armed pawl to be changed.

According to one embodiment, the actuating member of the electric on/off switch is actuable by means of a first arm of an angle lever arranged pivotably in the tool housing, wherein a second arm of the angle lever bears on the second arm of the two-armed pawl or a second arm of the angle lever is connected to the second arm of the two-armed pawl by means of a coupling joint. This provides a structurally simple deflection of the direction of movement, extending radially inward or outward with respect to the tool housing, of the two-armed pawl. The "articulated" coupling by means of components that merely touch one another and do not engage with one another provides a particularly simple structural design, wherein this connection is not suitable for transmitting tensile and compressive forces, however. If a coupling joint is used, the necessary installation space is reduced with a simultaneous reduction in frictional forces, resulting in a more precise response of the operating part. The coupling joint can be implemented for example by a connection between a pin and a slotted hole or slotted link and, in addition to a purely rotary movement, also allows a movement in translation of the two components connected together in such a way in relation to one another.

According to a further embodiment, the actuating member of the electric on/off switch is actuable by means of a transverse arm of a one-armed lever arranged in a pivotable manner in the tool housing, the one arm of said one-armed lever being connected at its end to a transverse arm of the second arm of the two-armed pawl via a coupling joint. On account of the one-armed lever positioned above the two-armed pawl in the tool housing, adaptation to other installation spaces is possible. In the context of the description, a transverse arm is understood to be an arm or bar that extends substantially perpendicularly to an arm of a lever or to a longitudinal axis of such an arm.

According to a further embodiment, the actuating member of the electric on/off switch is actuable by means of a toggle lever arranged in the tool housing, the central joint of said toggle lever being connected to an end-side transverse arm of the second arm of the two-armed pawl via a coupling joint. As a result, in the final portion of the actuating travel of the operating part, an increased axial actuating force acts on the actuating member of the electric on/off switch given a comparatively small actuating force on the part of the user.

According to a further embodiment, the actuating member of the electric on/off switch is actuable with the aid of a control cam bearing on the actuating member, and the control cam is formed on a transverse arm of the second lever arm of the two-armed pawl. As a result, a design of the operating part that is particularly simple because it is in one piece and also direct activation of the actuating member of the electric on/off switch are possible. The control cam can be formed for example with a wedge-shaped ramp. Furthermore, the operating part is very easy to mount and can additionally be produced cost-effectively for large-scale production, for example by an injection-molding process with a thermoplastic material.

According to a further embodiment, the actuating member of the electric on/off switch is actuable by means of a first and a second control cam, wherein the first and second control cams are formed in a mirror-symmetrical manner with respect to one another on a transverse arm formed perpendicularly on the second lever arm of the two-armed pawl, and in the event of an actuating force acting on the first or the second arm of the two-armed pawl, the first and second control cams each bear alternately on the actuating member. As a result, the rocker-like two-armed pawl has, away from its unloaded position, i.e. the position in which it is not actuated by the user, two defined switched-on positions in which the drive motor is powered or switched on. In an unactuated central position, the actuating member of the electric on/off switch bears on a planar "valley portion" or on a base surface or central surface. The control cams, which are for example wedge-shaped or curved, adjoin the planar valley portion on both sides, said control cams having a greater height than the valley portion.

According to a further embodiment, the operating part is formed with a one-armed pawl which is received in a pivotable manner at a pivot point on the tool housing, wherein the pivot point is arranged in a rear end portion, directed away from the tool receptacle, of the tool housing. Preferably, the one arm of the one-armed pawl has a protrusion directed toward the tool housing. As a result, the actuating force that is necessary for switching on and is to be applied by the user can be reduced further, wherein, at the same time, a high actuating force acts on the actuating member of the electric on/off switch.

Preferably, the actuating member of the electric on/off switch bears on a first arm of a two-armed lever arranged pivotably in the tool housing, and a second arm of the lever is actuable by means of a protrusion on the one-armed pawl. As a result of the interposed two-armed lever, indirect activation of the electric on/off switch by means of the operating part is realizable with simultaneously high force transmission.

The protrusion directed radially inward allows the two-armed lever arranged pivotably within the tool housing to be coupled for indirect activation of the actuating member of the electric on/off switch.

According to a further embodiment, the actuating member of the electric on/off switch is actuable by means of a two-armed lever which is articulated, by means of a coupling rod, on a protrusion formed substantially perpendicularly to a lever axis of the one-armed pawl. As a result, there are fewer contacting surfaces that are subject to friction. A first arm, bearing on the actuating member of the electric on/off switch, of the two-armed lever is preferably significantly longer than a second arm of the two-armed lever, which is articulated on the coupling rod. In this way, the necessary installation space can be reduced and mechanical transmission can be realized.

According to a further embodiment, the actuating member of the electric on/off switch is actuable by way of an at least regionally bow-shaped sliding switch that is received in the tool housing so as to be displaceable parallel to the longitudinal axis of the latter, wherein a first arm of the sliding switch is connected to the one-armed pawl via a coupling joint having a protrusion directed toward the tool housing, and a second arm of the sliding switch bears on the actuating member of the electric on/off switch. This results in particularly efficient utilization of the installation space available for activating the electric on/off switch.

According to a further embodiment, the operating part is formed with a toggle pawl. As a result, a comparatively high axial force acts on the actuating member of the electric on/off switch—in particular toward the end of the switching-on operation—even in the case of a relatively small actuating force.

The toggle pawl can, in this case, have, for direct actuation of the electric on/off switch, for example a first and a second arm, the ends of which that are directed toward one another being connected together at a central joint, wherein an end of the first arm that is directed away from the central joint is received at a pivot point on the tool housing and an end of the second arm that is directed away from the central joint is connected to the tool housing via a coupling joint. The actuation of the electric on/off switch takes place by way of an actuating arm provided at that end of the second arm that points away from the central joint. On account of the direct actuation of the electric on/off switch, the structural design is simplified.

Furthermore, a toggle pawl can be provided, which is provided for indirect actuation of the electric on/off switch. To this end, the toggle pawl has a first and a second arm, the ends of which that are directed toward one another are connected together at a central joint, wherein an end of the first arm that is directed away from the central joint is connected to the tool housing by means of a coupling joint and an end of the second arm that is directed away from the central joint is received at a pivot point on the tool housing. For indirect activation of the electric on/off switch, a first leg of a substantially L-shaped sliding switch that is received in the tool housing so as to be displaceable along the longitudinal axis is connected to the first arm of the toggle pawl via the coupling joint and a second leg of the sliding switch bears on the actuating member of the electric on/off switch. As a result, a rotary movement component at the plunger-like actuating member of the electric on/off switch is avoided.

Furthermore, a toggle pawl having an integrated switch-on inhibitor is possible. This toggle pawl comprises a first and a second arm, the ends of which that are directed toward one another being connected together at a central joint, wherein an end of the first arm that is directed away from the central joint is received at a pivot point on the tool housing and an end of the second arm that is directed away from the central joint is connected to the tool housing by means of a coupling joint. The electric on/off switch is again actuated directly, without an additional component being interposed, with the aid of an actuating arm which is formed at that end of the second arm that points away from the central joint and which bears on the actuating member of the electric on/off switch. The locking member of the switch-on inhibitor is received in a pivotable manner in the central joint, resulting in optimal utilization of the available installation space in the tool housing.

In order to achieve a simple structural design, the pivotable locking member has a blocking member and an actuating member arranged diametrically opposite the latter. In its locking state, the blocking member bears with its end side on a protrusion, directed radially outward, of the tool housing. By being pivoted slightly about the central joint, the blocking member is able to be set into its unlocking state, in which the central joint bears laterally on the protrusion such that the two arms of the toggle pawl are pivotable in the direction of the tool housing for actuating the electric on/off switch when the actuating force acts. As a result of the space-saving switch-on inhibitor integrated into the toggle pawl, the working safety when using the electric power tool is considerably increased, since accidental switching on of the drive motor, for example when carrying the power tool, is reliably prevented.

BRIEF DESCRIPTION OF THE DRAWINGS

The disclosure is explained in more detail in the following description by way of exemplary embodiments illustrated in the drawings, in which.

DETAILED DESCRIPTION

Figure 1:
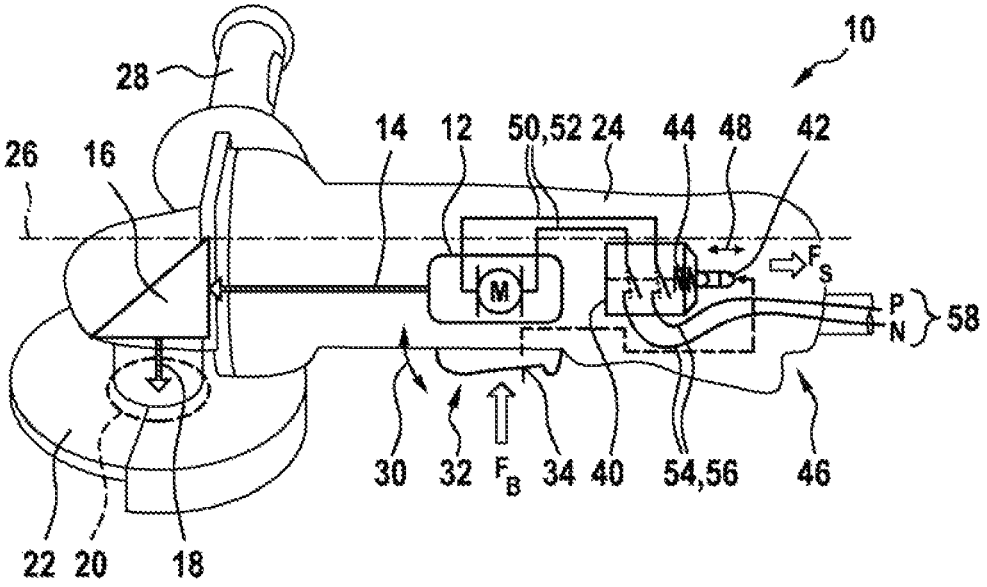
FIG. 1 shows a perspective view of an electric power tool having a lever-like operating part for actuating an electric on/off switch for switching a drive motor of the electric power tool according to the present disclosure on and off.

FIG. 1 shows an electric power tool 10 which is configured, as illustrated, in the form of a handheld angle grinder and has a tool housing 24 having a drive motor 12 of any desired motor type, for example an electronically commutated motor or a DC motor, arranged therein. The energy supply of the drive motor 12 takes place here for example via a mains supply line 58. Alternatively or in addition, the energy supply can also take place by way of one or more associated battery packs.

The drive motor 12 serves to drive a drive shaft 14 which is preferably connected to a tool receptacle 20 via an angular transmission 16 and an output shaft 18. The tool receptacle 20 is preferably configured to receive an application tool 22 that is able to be driven in rotation, for example a grinding, roughing or cut-off wheel.

The tool housing 24 which is configured, as illustrated, in the form of a bar has a longitudinal axis 26 and serves, in addition to a handle 28 arranged transversely to the longitudinal axis 26 on the tool housing 24, as a further handle, such that safe, two-handed grasping and holding of the electric power tool 10 by a user is possible. A lever-like operating part 32 for switching the drive motor 12 on and off when an actuating force $F_B$ to be applied by a user acts thereon, said operating part 32 being pivotable in the direction of a double arrow 30, is provided on the tool housing 24. The lever-like operating part 32 extends at least regionally and preferably approximately parallel to the longitudinal axis 26 of the tool housing 24 and preferably has a large-area, ergonomic operating surface 34 that is directed away from the tool housing 24.

The electric power tool 10 furthermore has an electric on/off switch 40 with a plunger-like actuating member 42 for switching the drive motor 12 on and off, said actuating member 42 being displaceable preferably parallel to the longitudinal axis 26 and being mechanically connected at least indirectly to the pivotable lever-like operating part 32. The on/off switch 40, which is preferably embodied as a two-pole switch, is electrically connected, for example via two flexible lines 50, 52, electrically to the drive motor 12 and to two further flexible lines 54, 56, live (P) and neutral (N), of the mains supply line 58. Both the electric on/off switch 40 and the mains supply line 58 are located in the rear end portion 46 of the tool housing 24. The electric on/off switch 40 can, unlike in FIG. 1, also be positioned in the tool housing 24 in a manner rotated through 180°.

In the illustration in FIG. 1, the electric on/off switch 40 is in a switched-off state and the drive motor 12 is switched off, while in a switched-on state—indicated here merely by dotted lines—of the electric on/off switch 40 with a depressed or actuated actuating member 42, the drive motor 12 is switched on. The actuating member 42 of the electric on/off switch 40 is preferably mechanically pretensioned by means of a spring 44 in the direction of a rear end portion 46, pointing away from the tool receptacle 20, of the tool housing 24. In order to switch the drive motor 12 on and furthermore to keep it permanently in the switched-on state, it is therefore necessary for the actuating force $F_B$ to act permanently on the operating part 32 in order to overcome the restoring force $F_S$ applied at least by the spring 44. As a result, the actuating member 42 is brought into and kept in its depressed or actuated state and the electric on/off switch 40 is permanently in the switched-on state. In all of the embodiments in accordance with FIG. 1 to FIG. 24, the actuating force $F_B$ to be applied by the user preferably always acts at least approximately and substantially perpendicularly to the longitudinal axis 26 of the tool housing 24, whereas an axial movement of the plunger-like actuating member 42 of the electric on/off switch 40 preferably always takes place at least approximately parallel to the longitudinal axis 26 of the tool housing 24, or in the direction of a double arrow 48. If the operating part 32 is released in a controlled or uncontrolled manner, the electric on/off switch 40 returns automatically into the switched-off state, in which the drive motor 12 is not powered, on account of the force applied by the spring 44, thereby providing a "dead man's" function of the electric power tool 10 to prevent against accidents.

Figure 2:
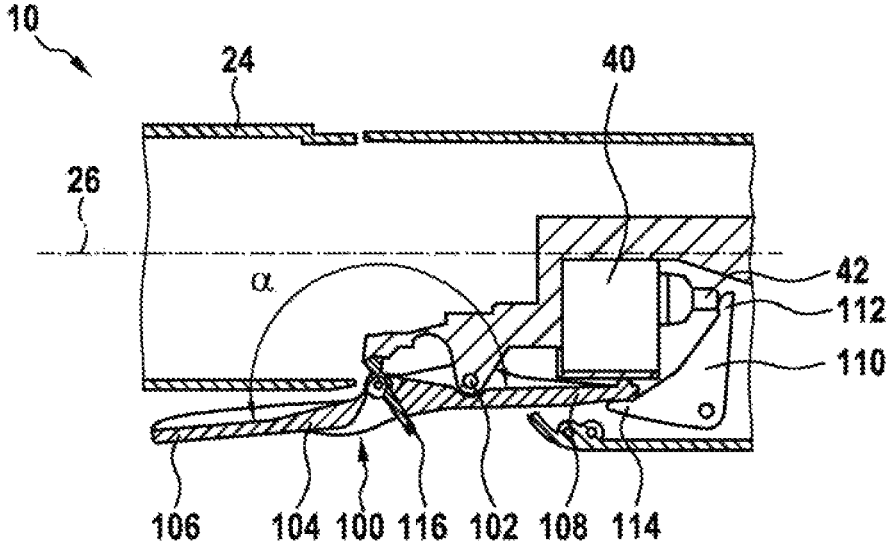
FIGS. 2, 3 show a first embodiment of an operating part, usable with the electric power tool from FIG. 1, in a switched-off and switched-on state of the electric on/off switch.
Figure 3:
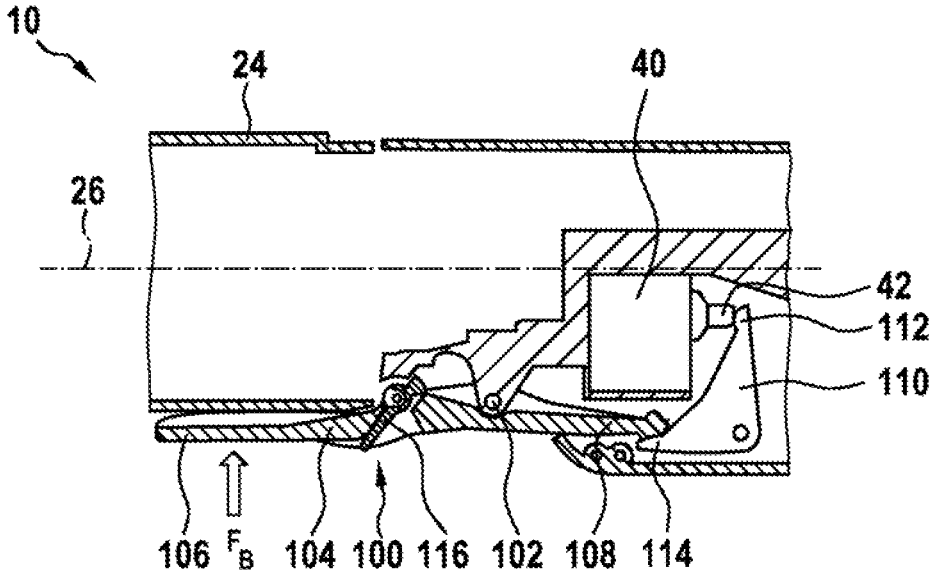

FIG. 2 and FIG. 3—to which reference is also made in the rest of the description—show a first embodiment of a lever-like operating part 100 which is received in the tool housing 24 of the electric power tool 10 from FIG. 1 so as to be pivotable about a pivot point 102 and is preferably formed by a two-armed pawl 104. The latter preferably has a first and a second arm 106, 108 on either side of the pivot point 102, said arms being configured so as to have an approximately equal length, here. The two arms 106, 108 enclose, as illustrated, an angle $\alpha$, which can be between 140° and 240°.

The actuating member 42 of the electric on/off switch 40 is preferably activated indirectly by a, for example triangular, angle lever 110 which is received in a pivotable manner in the tool housing 24 and for its part has a first and a second arm 112, 114. On account of the force applied by the spring 44 of the electric on/off switch 40, the actuating member 42 thereof always bears on the first arm 112 of the angle lever 110. The same goes for the second arm 114 of the angle lever 110, which bears on the second arm 108 of the two-armed pawl 104. A locking member 116 that is received in a pivotable manner on the operating part 100 prevents undesired actuation of the electric on/off switch 40 and thus uncontrolled switching on of the electric power tool 10.

When the actuating force $F_B$ acts on the first arm 106 of the two-armed pawl 104, the latter pivots in the clockwise direction and the angle lever 110 coupled thereto pivots in the counterclockwise direction. As a result, the plunger-like actuating member 42 is displaced in the direction of the electric on/off switch 40 parallel to the longitudinal axis 26, and the electric on/off switch 40 is set into its switched-on state, in which the drive motor 12 of the electric power tool 10 is powered. This switched-on state remains active for as long as the actuating force $F_B$ acts on the first arm 106 of the two-armed pawl 104. If there is no actuating force $F_B$ or the operating part 100 is released by the user, the two-armed pawl 104 and, together therewith, the angle lever 110 return automatically into the switched-off state of the electric on/off switch 40 in FIG. 2 as part of its "dead man's" functionality, which is implemented in all of the embodiments of operating parts that are described in the following text.

Figure 4:
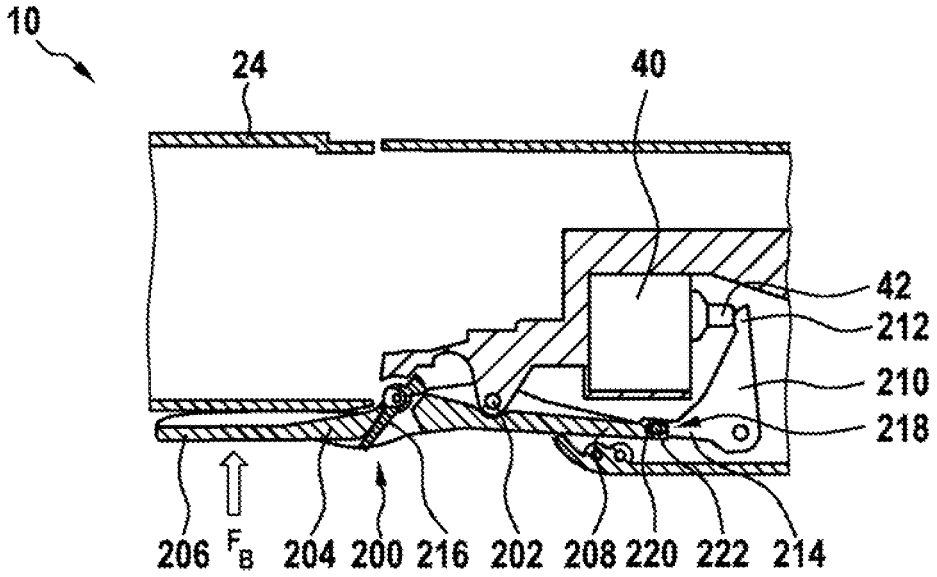
FIG. 4 shows a second embodiment of an operating part, usable with the electric power tool from FIG. 1, in a switched-on state of the electric on/off switch.

FIG. 4 shows a second embodiment of a lever-like operating part 200 which is received in the tool housing 24 of the electric power tool 10 from FIG. 1 so as to be pivotable about a pivot point 202 and is again preferably formed by a two-armed pawl 204. The latter preferably has a first and a second arm 206, 208 on either side of the pivot point 202. The actuating member 42 of the electric on/off switch 40 is activated indirectly by a, preferably triangular, angle lever 210 which is received in a pivotable manner in the tool housing 24 and for its part has a first and a second arm 212, 214. The latter can be the same length or be different lengths, depending on the desired transmission ratio. By way of a blocking member 216, undesired actuation of the operating part 200 and uncontrolled switching on of the electric power tool 10 are avoided.

In contrast to the first embodiment according to FIG. 2 and FIG. 3, the second arm 208 of the two-armed pawl 204 of the operating part 200 and the second arm 214 of the angle lever 210 are connected together by means of a coupling joint 218. This coupling joint 218 preferably comprises a slotted hole 220 in the second arm 208, a peg 222 on the second arm 214 engaging in said slotted hole 220. The actuating member 42 of the electric on/off switch 40 again bears on the first arm 212 of the angle lever 210 on account of its axial pretensioning. In the position illustrated in FIG. 4, the electric on/off switch 40 is in the switched-on state on account of the actuating force $F_B$ acting on the operating part 200.

Figure 5:
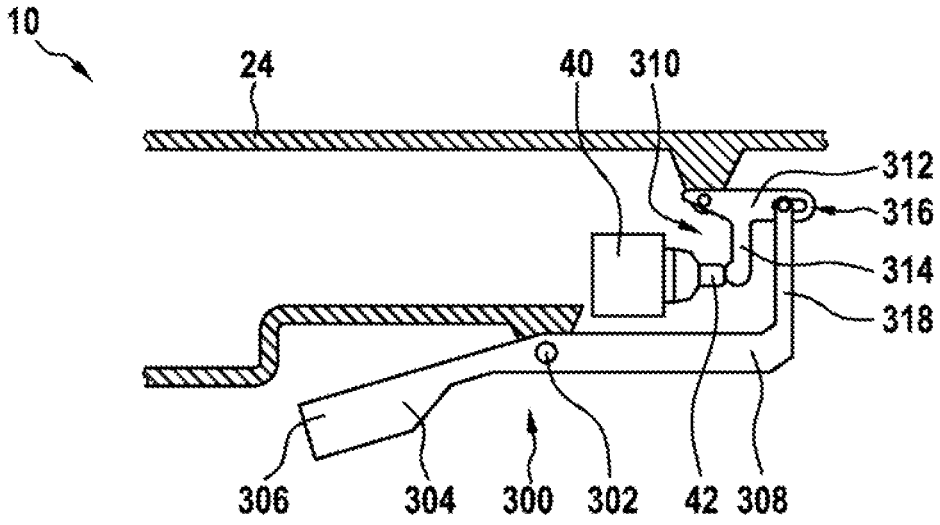
FIGS. 5, 6 show a third embodiment of an operating part, usable with the electric power tool from FIG. 1, in a switched-off and switched-on state of the electric on/off switch.
Figure 6:
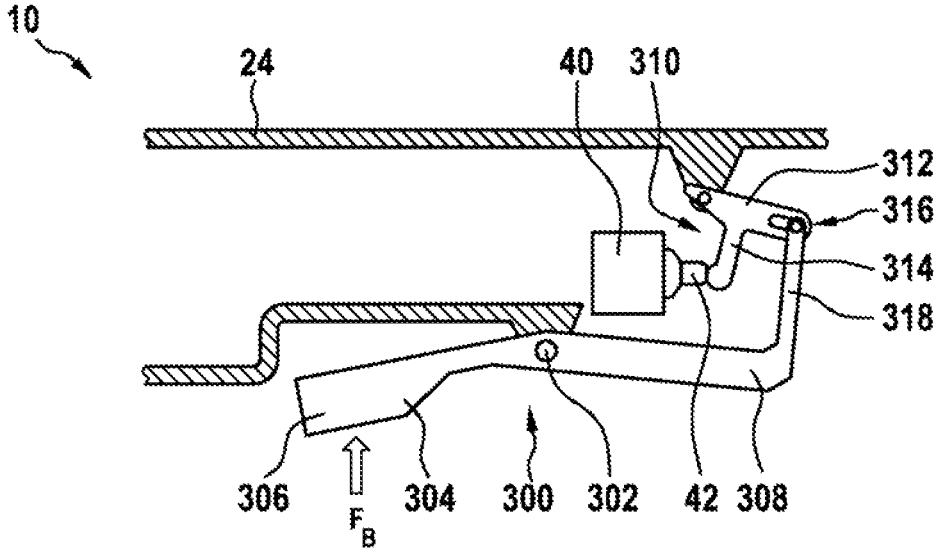

FIG. 5 and FIG. 6—to which reference is also made in the rest of the description—show a third embodiment of a lever-like operating part 300 which is received in the tool housing 24 of the electric power tool 10 from FIG. 1 so as to be pivotable about a pivot point 302 and is preferably again formed by a two-armed pawl 304. The latter preferably has a first and a second arm 306, 308 on either side of the pivot point 302. The actuating member 42 of the electric on/off switch 40 is activated indirectly with the aid of a one-armed lever 310 which is received in a pivotable manner in the tool housing 24 and the one arm 312 of which has a transverse arm 314 which bears on the plunger-like actuating member 42. The one arm 312 of the one-armed lever 310 is connected in an articulated manner by means of a coupling joint 316 to a further transverse arm 318 that is preferably formed on the end of the second arm 308 of the two-armed pawl 304.

In the position illustrated in FIG. 5, the on/off switch 40 is in the switched-off state, in which the plunger-like actuating member 42 projects farthest out of the on/off switch 40, the drive motor 12 of the electric power tool 10 is not powered and the unloaded first arm 306 of the two-armed pawl 304 has been lifted off the tool housing 24 in a manner directed radially outward. According to FIG. 6, the actuating force $F_B$ acts on the two-armed pawl 304 of the operating part 300 such that the latter, as illustrated, pivots in the clockwise direction about the pivot point 302 and the one-armed lever 310 likewise pivots in the clockwise direction along therewith, such that the transverse arm 314 of the one-armed lever 310 depresses or actuates the operating member 42 and the drive motor 12 of the electric power tool 10 is switched on. If there is no actuating force $F_B$, the electric on/off switch 40 is automatically set back into the switched-off state in FIG. 5.

Figure 7:
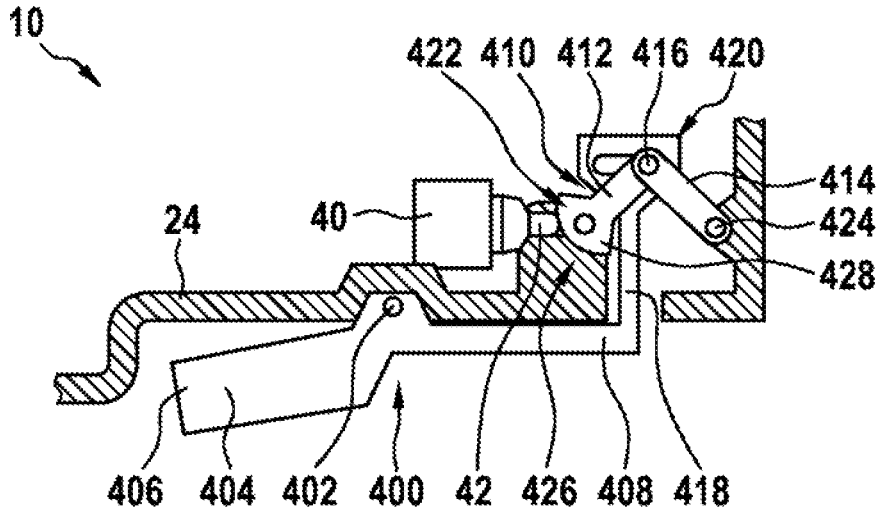
FIGS. 7, 8 show a fourth embodiment of an operating part, usable with the electric power tool from FIG. 1, in a switched-off and switched-on state of the electric on/off switch.
Figure 8:
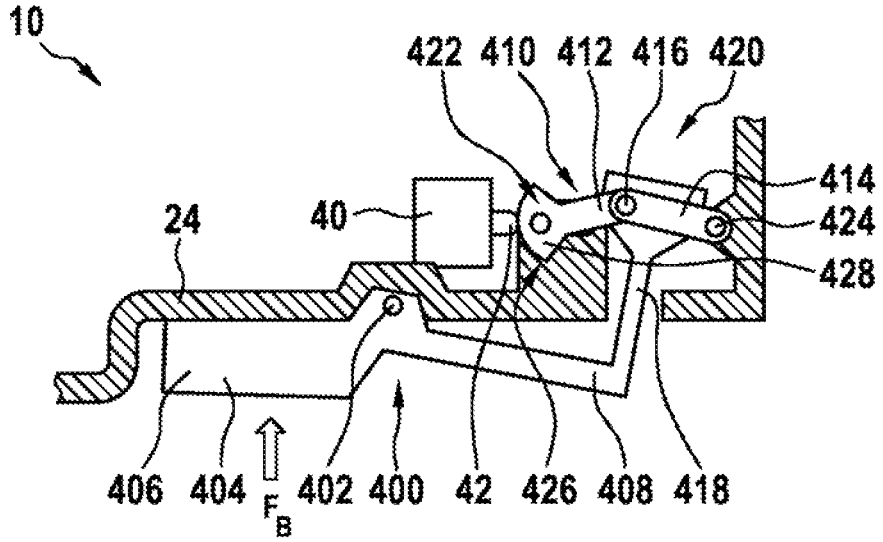

FIG. 7 and FIG. 8—to which reference is also made in the rest of the description—show a fourth embodiment of a lever-like operating part 400 which is received in the tool housing 24 of the electric power tool 10 from FIG. 1 so as to be pivotable about a pivot point 402 and is preferably realized by a two-armed pawl 404. The latter preferably has a first and a second arm 406, 408, preferably approximately the same length, on either side of its pivot point 402.

The actuating member 42 of the electric on/off switch 40 is activated indirectly and for force reinforcement with the aid of a toggle lever 410 which is received in a pivotable manner in the tool housing 24 and has a first and a second arm 412, 414, wherein a central joint 416 of the toggle lever 410 is connected in an articulated manner via a coupling joint 420 to an end-side transverse arm 418 of the second arm 408 of the two-armed pawl 404. The first arm 412 of the toggle lever 410 is connected to the tool housing 24 by means of a further coupling joint 422, while the second arm 414 of the toggle lever 410 is articulated at its end at a pivot point 424 on the tool housing 24. To mechanically activate the electric on/off switch 40, a curved thrust surface 426, which is formed at an end 428, directed away from the central joint 416, of the second arm 412 of the toggle lever 410, bears on the actuating member 42 of said on/off switch 40 that is axially pretensioned by spring loading. According to FIG. 7, the operating part 400 is unloaded, or has been released by the user, such that the electric on/off switch 40 is in the switched-off state and the drive motor 12 of the electric power tool 10 is switched off. By contrast, in FIG. 8, the actuating force $F_B$ is acting on the first arm 406 of the two-armed pawl 404 of the operating part 400, such that the toggle lever 410 has taken up a virtually fully extended position and the electric on/off switch 40 is in the switched-on state with the actuating member 42 virtually fully depressed, and the drive motor 12 of the electric power tool 10 is switched on.

Figure 9:
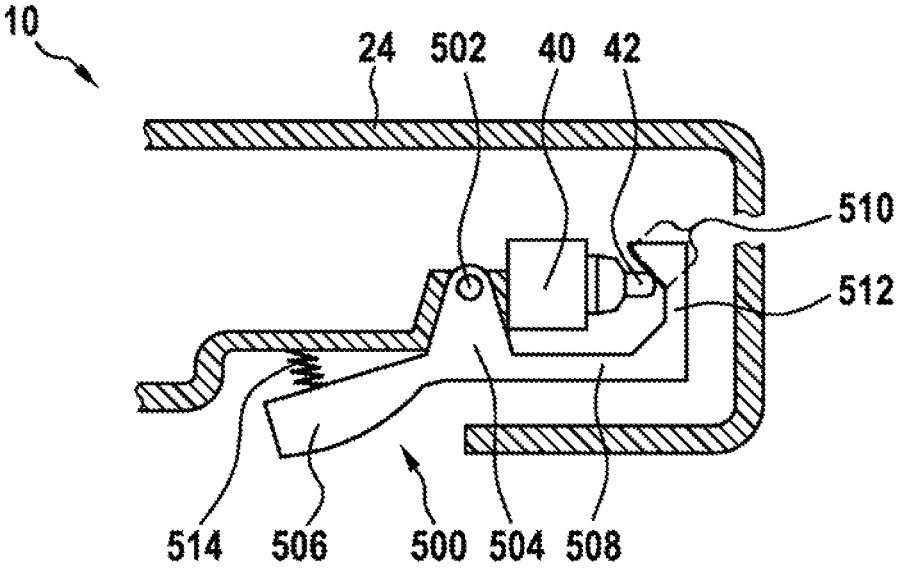
FIGS. 9, 10 show a fifth embodiment of an operating part, usable with the electric power tool from FIG. 1, in a switched-off and switched-on state of the electric on/off switch.
Figure 10:
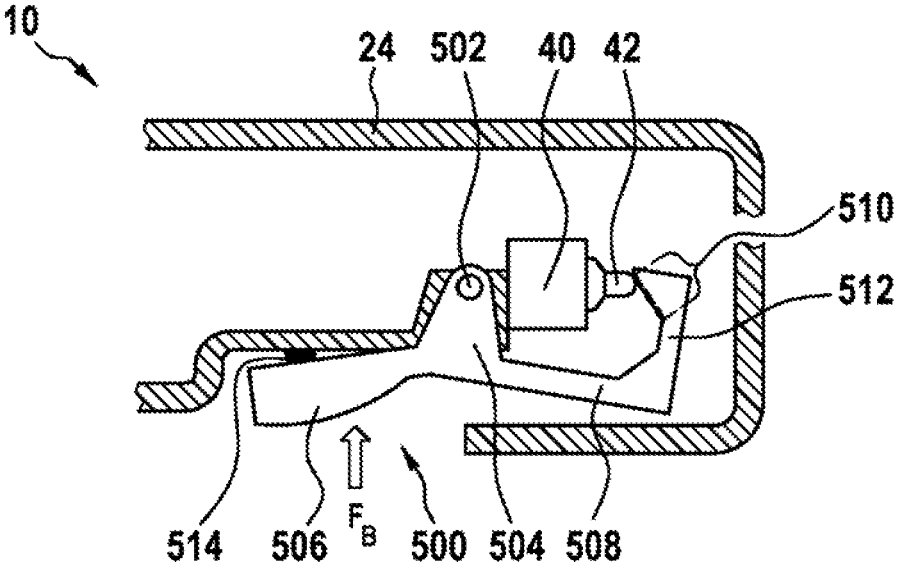

FIG. 9 and FIG. 10—to which reference is also made in the rest of the description—show a fifth embodiment of a lever-like operating part 500 which is received in the tool housing 24 of the electric power tool 10 from FIG. 1 so as to be pivotable about a pivot point 502. Said operating part 400 is preferably formed by a two-armed pawl 504 which preferably has a first and a second arm 506, 508 on either side of its pivot point 502.

In contrast to the previous embodiments, the actuating member 42 of the electric on/off switch 40 is preferably activated directly with the aid of a control cam 510 which bears on the plunger-like actuating member 42. The control cam 510 is formed on a transverse arm 512 preferably formed integrally on the end of the second arm 508 of the two-armed pawl 504 and in this case has for example a ramp-like or wedge-shaped form.

If, as is schematically shown in FIG. 10, the actuating force $F_B$ acts on the first arm 506 of the two-armed pawl 504, the latter is pivoted slightly about its pivot point 502 in the clockwise direction, wherein the actuating member 42, axially pretensioned by spring loading, of the electric on/off switch 40 runs onto the wedge-shaped control cam 510 and in the process is depressed. As a consequence, the electric on/off switch 40 is set into the switched-on state and the drive motor 12 of the electric power tool 10 is powered. If there is no actuating force $F_B$ or the operating part 500 is released by the user, the operation is reversed, such that the actuating member 42 rebounds and the drive motor 12 of the electric power tool 10 is switched off. It is important here that an inclination or gradient of the control cam 510 is preferably so shallow that, when the operating part 500 is released, the electric on/off switch 40 returns automatically into the switched-off state in FIG. 9, but, on the other hand, there is a sufficient actuating stroke of the actuating member 42 to reliably switch the electric on/off switch 40 on and off. In order to support this operation, a return spring 514 can be provided, which is supported between the tool housing 24 and the first arm 506 of the two-armed pawl 504.

Figure 11:
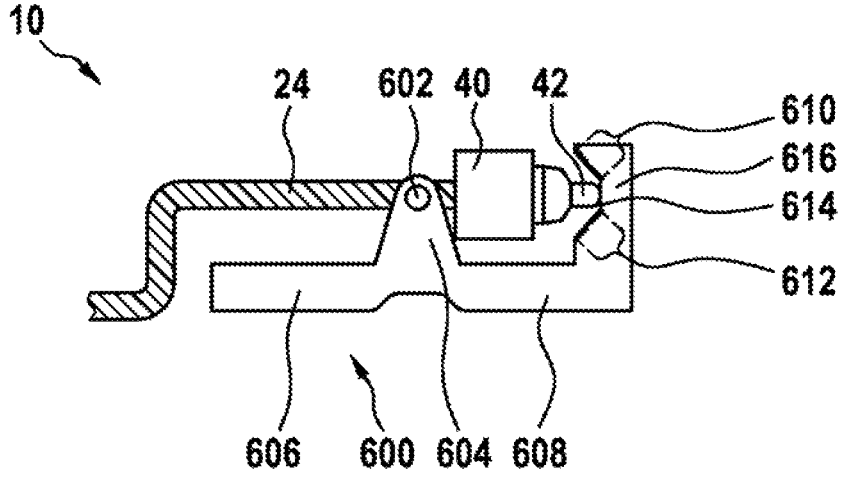
FIGS. 11-13 show a sixth embodiment of an operating part, usable with the electric power tool from FIG. 1, in a switched-off and switched-on state of the electric on/off switch.
Figure 12:
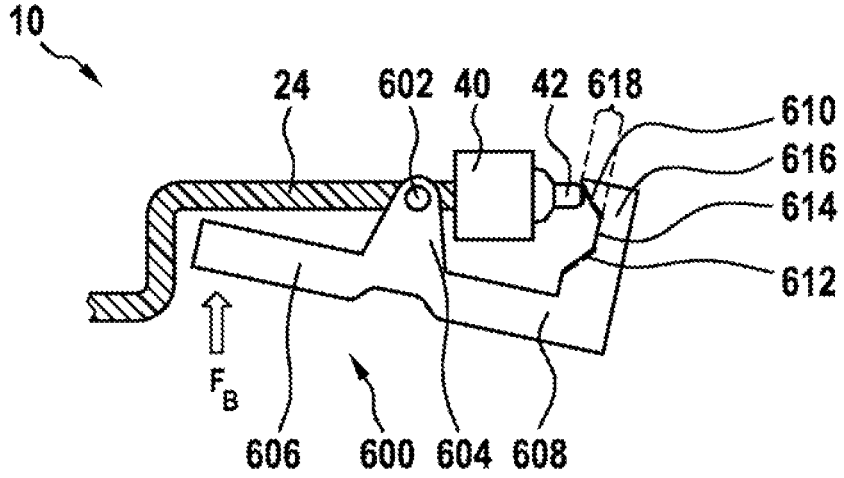
Figure 13:
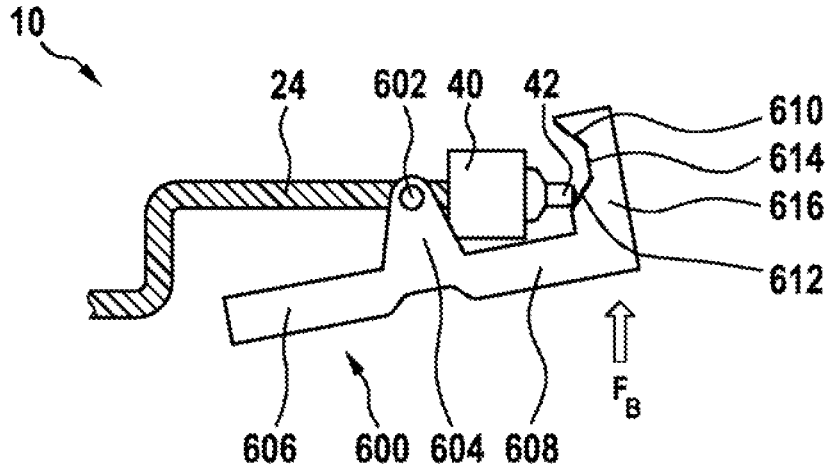

FIG. 11 to FIG. 13—to which reference is also made in the rest of the description—show a sixth embodiment of a lever-like operating part 600 which is received in the tool housing 24 of the electric power tool 10 from FIG. 1 so as to be pivotable about a pivot point 602 and is preferably formed by a rocker-like two-armed pawl 604. The latter preferably has a first and a second arm 606, 608 on either side of its pivot point 602. The arms 606, 608 can in this case be configured to be substantially the same length or can also have a length difference of up to 50% with respect to one another.

In contrast to the embodiment in FIG. 9 and FIG. 10, the actuating member 42 of the electric on/off switch 40 is activated with the aid of a first and a second control cam 610, 612 and a valley portion 614. In the case of an operating part 600 released by the user or in the unloaded state, the actuating member 42, as can be seen from FIG. 11, bears on the planar valley portion 614, which extends approximately centrally between the control cams 610, 612 that are configured in a mirror-symmetrical manner to one another and are for example wedge-shaped or ramp-shaped here. In the region of the valley portion 614 between the control cams 610, 612, the actuating member 42 can fully rebound, with the result that the electric on/off switch 40 is in the switched-off state and the drive motor 12 of the electric power tool 10 is switched off. The control cams 610, 612 and the valley portion 614 extending in between are formed on an end-side transverse arm 616 of the second arm 608 of the two-armed pawl 604.

If the actuating force $F_B$ acts on the first arm 606 or on the second arm 608 of the pawl 604, then, according to FIG. 12, either the first control cam 610 or, as is apparent from FIG. 13, the second control cam 612 bears on the actuating member 42 of the electric on/off switch 40, with the result that the actuating member 42, given a sufficiently large pivot of the operating part 600 clockwise or counterclockwise about the pivot point 602, is depressed and the electric on/off switch 40 is set into the switched-on state and the drive motor 12 of the electric power tool 10 is switched on. With the operating part 600 released, the latter returns automatically into the position in FIG. 11, in which the electric on/off switch 40 is in the switched-off state, on account of the actuating member 42 that is axially pretensioned by spring loading.

In contrast to the embodiment in FIG. 9 and FIG. 10, the operating part 600 has two positions in which the electric on/off switch 40 is in the switched-on state, thereby allowing more universal handling of the electric power tool 10. A height 618 (cf. FIG. 12) of the control cams 610, 612 is preferably dimensioned with regard to the valley portion 614 such that the electric on/off switch 40 is able to be switched on and off reliably, starting from the unloaded state of the operating part 600 according to FIG. 11, by the pivoting movement.

Figure 14:
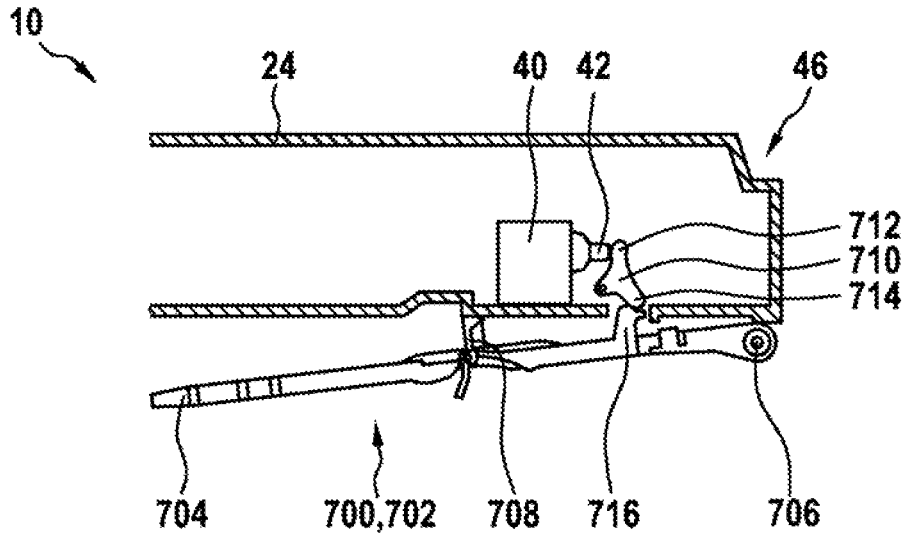
FIGS. 14, 15 show a seventh embodiment of an operating part, usable with the electric power tool from FIG. 1, in a switched-off and switched-on state of the electric on/off switch.
Figure 15:
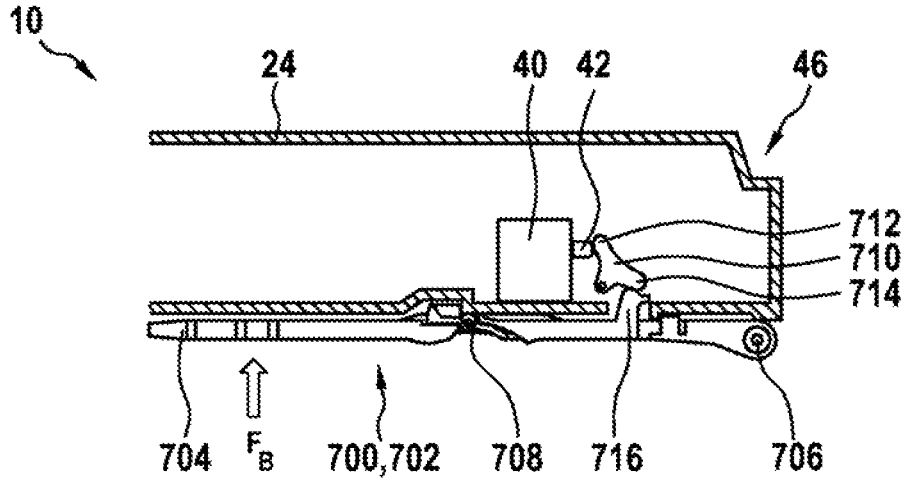

FIG. 14 and FIG. 15—to which reference is also made in the rest of the description—show a seventh embodiment of a lever-like operating part 700 which, unlike all of the embodiments explained above, is formed with a one-armed pawl 702, the one arm 704 of which is articulated at a pivot point 706 in the rear end portion 46 (cf. FIG. 1) of the tool housing 24 of the electric power tool 10 from FIG. 1. By way of a blocking member 708 arranged in a pivotable manner on the arm 704, undesired actuation of the operating part 700 and thus accidental switching on of the electric power tool 10 are avoided.

The actuating member 42, axially pretensioned by spring loading, of the electric on/off switch 40 is activated again indirectly here by means of a two-armed lever 710, received in a pivotable manner in the tool housing 24, having a first and a second arm 712, 714. The actuating member 42 bears on the first arm 712 of the two-armed lever 710, while the second arm 714 bears on a protrusion 716 which is formed on the arm 704 of the one-armed pawl 702 and which faces the tool housing 24.

In FIG. 14, the electric on/off switch 40 is in the switched-off state, such that the drive motor 12 of the electric power tool 10 is not powered. If, with the blocking member 708 pivoted in the counterclockwise direction, the actuating force $F_B$ acts on the arm 704 of the one-armed pawl 702, the protrusion 716 of the one-armed pawl 702 presses against the second arm 714 of the lever 710, with the result that the latter pivots in the counterclockwise direction and the first arm 712 of the lever 710 of the actuating member 42 is depressed until the electric on/off switch 40 is set into the switched-on state in which the drive motor 12 of the electric power tool 10 is powered. If the one-armed pawl 702 is released again, the actuating member 42 presses against the first arm 712 of the lever 710 which consequently pivots in the clockwise direction. As a result, the second arm 714 of the lever 710 pushes the protrusion 716 radially outward such that the one-armed pawl 702 automatically takes up the position, raised from the tool housing 24, in FIG. 14 and the electric on/off switch is in the switched-off state.

Figure 16:
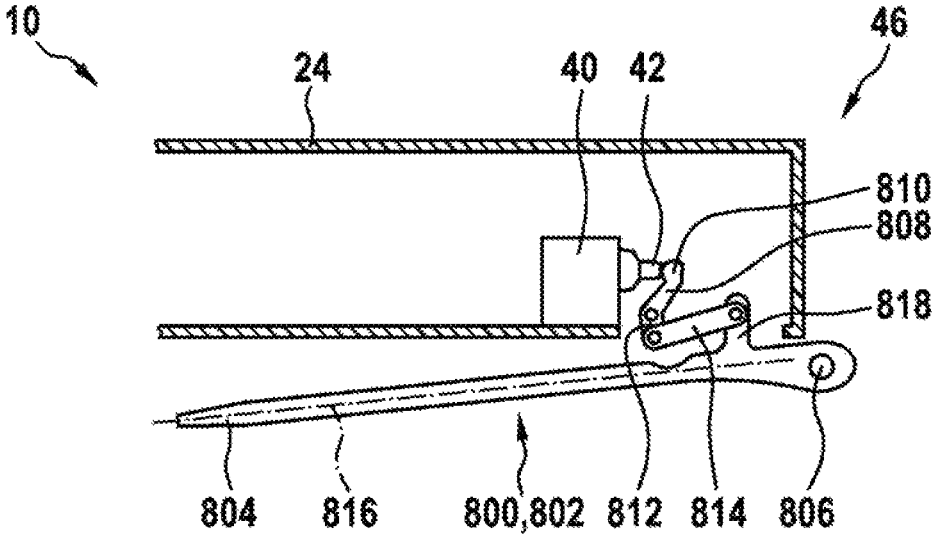
FIGS. 16, 17 show an eighth embodiment of an operating part, usable with the electric power tool from FIG. 1, in a switched-off and switched-on state of the electric on/off switch.
Figure 17:
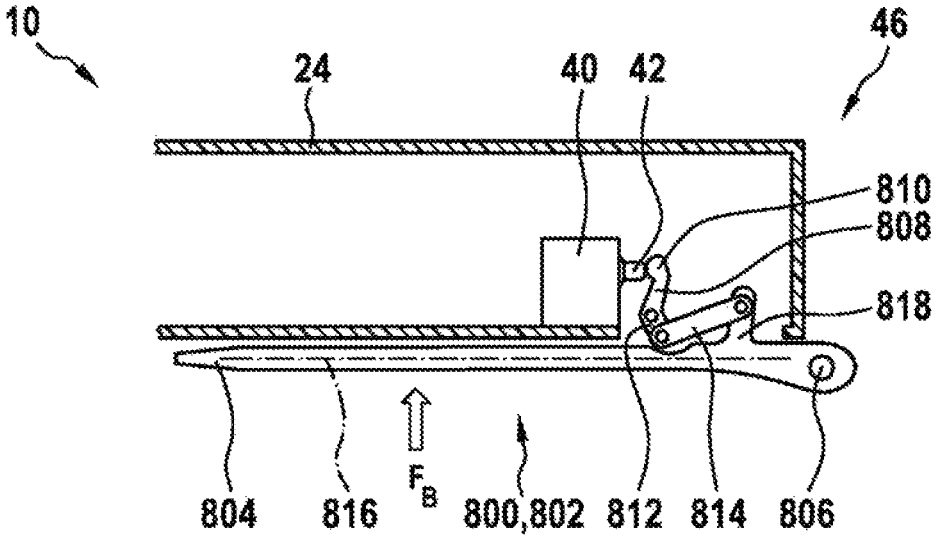

FIG. 16 and FIG. 17—to which reference is also made in the rest of the description—show an eighth embodiment of a lever-like operating part 800 which is preferably formed with a one-armed pawl 802, the one arm 804 of which is articulated preferably at a pivot point 806 in the rear end portion 46 (cf. FIG. 1) of the tool housing 24 of the electric power tool 10 from FIG. 1. The actuating member 42, axially pretensioned by spring loading, of the electric on/off switch 40 is likewise activated indirectly here by means of a two-armed lever 808, received in a pivotable manner in the tool housing 24, having a first and a second arm 810, 812, wherein the first arm 810 is configured here for example in a much longer manner than the second arm 812. The actuating member 42 bears on the first arm 810, while the second arm 812 is articulated via a coupling rod 814 on a protrusion 818 formed at least approximately perpendicularly to a lever axis 816 of the arm 804 of the one-armed pawl 802.

In FIG. 16, the electric on/off switch 40 is in the switched-off state, such that the drive motor 12 of the electric power tool 10 is not powered. With an actuating force $F_B$ acting thereon, the one-armed pawl 802 comes to bear, according to FIG. 17, on the tool housing 24, with the result that the lever 808 is pivoted in the counterclockwise direction, as illustrated, by means of the coupling rod 814 and the first arm 810 of the lever 808 depresses the actuating member 42 of the electric on/off switch 40 and sets the latter into the switched-on state. When the one-armed pawl 802 is released, the operations are reversed and the electric on/off switch 40 automatically takes up its switched-off state, in which the operating part 800 or the one-armed pawl 802 is raised at the same time from the tool housing 24.

Figure 18:
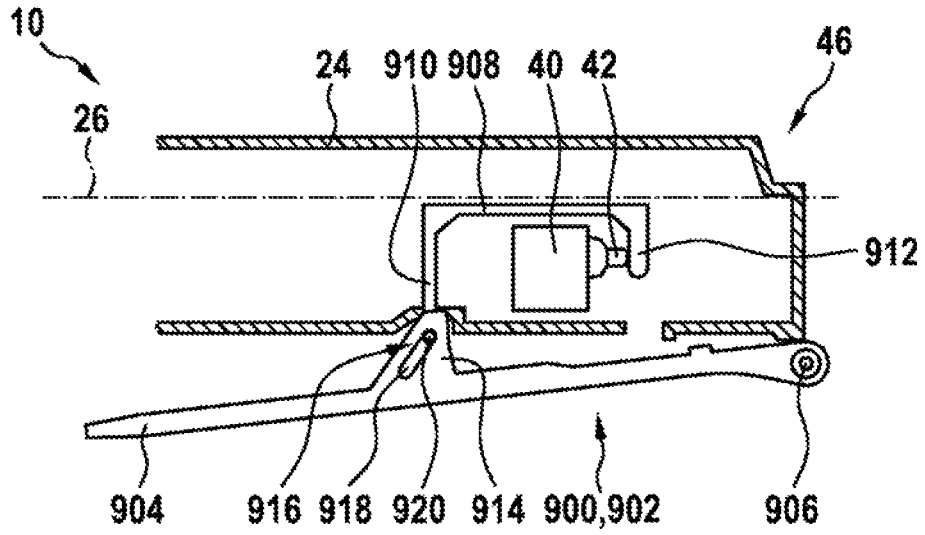
FIGS. 18, 19 show a ninth embodiment of an operating part, usable with the electric power tool from FIG. 1, in a switched-off and switched-on state of the electric on/off switch.
Figure 19:
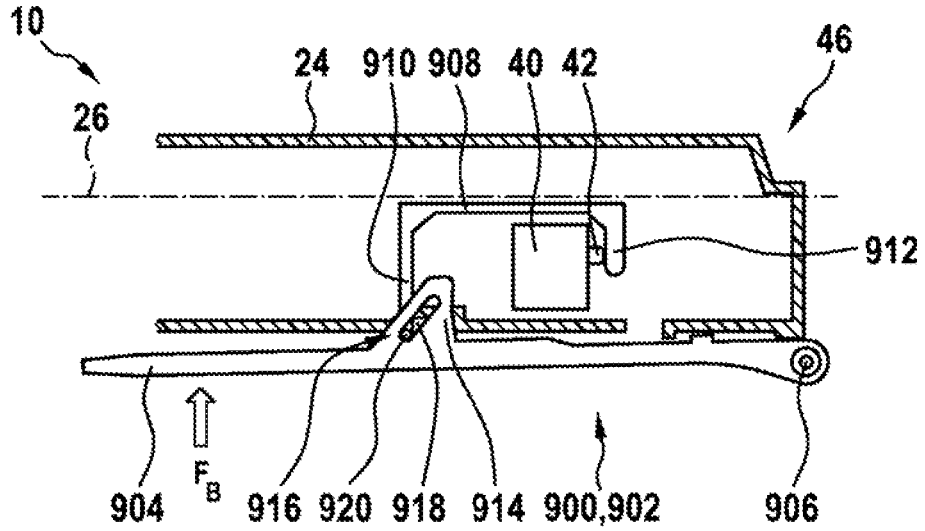

FIG. 18 and FIG. 19—to which reference is also made in the rest of the description—show a ninth embodiment of a lever-like operating part 900 having a one-armed pawl 902, the one arm 904 of which is articulated preferably at a pivot point 906 in the rear end portion 46 (cf. FIG. 1) of the tool housing 24 of the electric power tool 10 from FIG. 1. The actuating member 42, axially pretensioned by spring loading, of the electric on/off switch 40 is activated preferably indirectly here by means of a bow-shaped or U-shaped sliding switch 908, received in the tool housing 24 so as to be displaceable parallel to the longitudinal axis 26, having a first and a second end 910, 912.

A triangular protrusion 914 that is directed radially inward with respect to the tool housing 24 is preferably formed on the arm 904 of the one-armed pawl 902, said triangular protrusion 914 serving for the articulated coupling of the operating part 900 to the bow-shaped sliding switch 908. The first end 910 of the bow-shaped sliding switch 908 is connected to the operating part 900 or to the arm 904 in an articulated manner by means of a coupling joint 916, which allows a combined movement sequence in rotation and translation. The coupling joint 916 is preferably constructed with a slotted hole 918 or a slotted guide in the protrusion 914 and a peg 920, received therein, at the first end 910 of the bow-shaped sliding switch 908. The slotted hole 918 is embodied in an inclined manner with respect to the longitudinal axis 26. The second end 912 of the bow-shaped sliding switch 908 bears on the actuating member 42 of the electric on/off switch 40.

In the illustration in FIG. 18, the electric on/off switch 40 is in the switched-off state, wherein the actuating member 42, axially pretensioned by spring loading, pivots the operating part 900, with the aid of the bow-shaped sliding switch 908 and the coupling joint 916, into the shown position raised from the tool housing 24. According to FIG. 19, the actuating force $F_B$ acts on the operating part 900 such that the latter pivots in the clockwise direction about the pivot point 906 and the peg 920 is displaced in the slotted hole 918. As a result, the sliding switch 908, and thus the second end thereof 912, is displaced parallel to the longitudinal axis 26 in the direction of the electric on/off switch 40, such that the operating member 42 thereof is depressed and the switched-on state of the electric on/off switch 40 is reached, in which the drive motor 12 of the electric power tool 10 is switched on. In the switched-on state of the electric on/off switch 40, the operating part 900, as is apparent from FIG. 19, bears at least sectionally on the tool housing 24 and extends parallel to the longitudinal axis 26 of the tool housing 24. If the operating part 900 or the one-armed pawl 902 is released, i.e. the actuating force $F_B$ does not act on the operating part 900, the operations are reversed and the electric on/off switch 40 reaches the switched-off state, illustrated in FIG. 18, in which the drive motor 12 of the electric power tool 10 is not powered.

Figure 20:
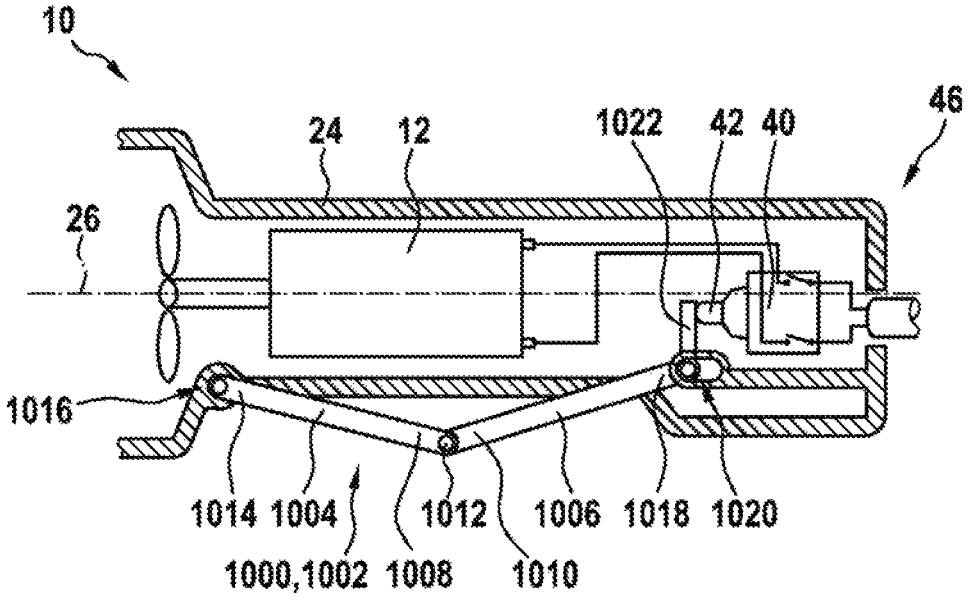
FIGS. 20, 21 show a tenth embodiment of an operating part, usable with the electric power tool from FIG. 1, in a switched-off and switched-on state of the electric on/off switch.
Figure 21:
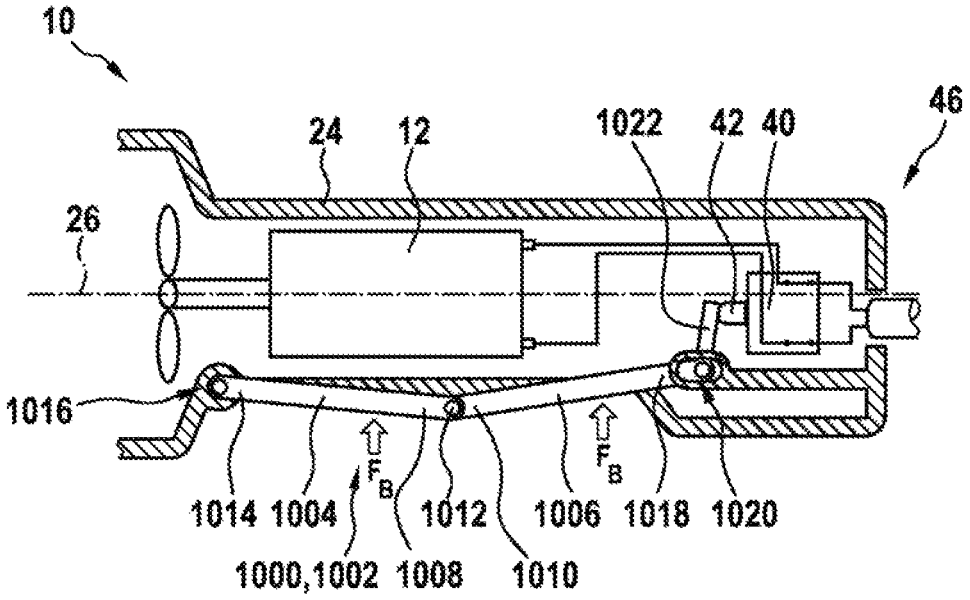

FIG. 20 and FIG. 21—to which reference is also made in the rest of the description—show a tenth embodiment of a preferably double-lever-like operating part 1000, which is preferably formed, unlike all of the embodiments explained above, with a toggle pawl 1002. The latter preferably comprises a first and a second arm 1004, 1006, the ends 1008, 1010 of which that face one another are connected together in an articulated manner at a central joint 1012. A further end 1014, directed away from the central joint 1012, of the first arm 1004 is received in a rotatable manner at a pivot point 1016 on the tool housing 24. A further end 1018, directed away from the central joint 1012, of the second arm 1006 is received in a displaceable and pivotable manner in a coupling joint 1020. At the end 1018, pointing away from the central joint 1012, of the second arm 1006, an actuating arm 1022 is formed, preferably integrally, at least approximately perpendicularly to said second arm 1006, said actuating arm 1022 bearing on the actuating member 42, axially pretensioned by spring loading, of the electric on/off switch 40. In contrast to all of the preceding embodiments, the actuating member 42 points away from the rear end portion 46 of the tool housing 24, i.e. is integrated in the tool housing 24 in an inverted manner.

As is apparent from FIG. 20, the operating part 1000 or the toggle pawl 1002 is unloaded or released by the user, such that the electric on/off switch 40 is in the switched-off state and the drive motor 12 of the electric power tool 10 is switched off. If the actuating force $F_B$ now acts on the toggle pawl 1002 at any desired point along its longitudinal extent, said toggle pawl 1002 is brought into the at least partially extended state in FIG. 21. In this case, the end 1018 of the second arm 1006 and, together therewith, the actuating arm 1022 is displaced in the direction of the rear end portion 46 of the tool housing 24 and actuates the actuating member 42 or depresses the latter, such that the electric on/off switch 40 is set into the switched-on state and the drive motor 12 of the electric power tool 10 is switched on. With the operating part 1000 released or unloaded, the operations are reversed and the electric on/off switch 40 passes automatically into the switched-off state in FIG. 20, in which the toggle pawl 1002 has been pressed back into the position raised from the tool housing 24 on account of the force applied by the actuating member 42.

Figure 22:
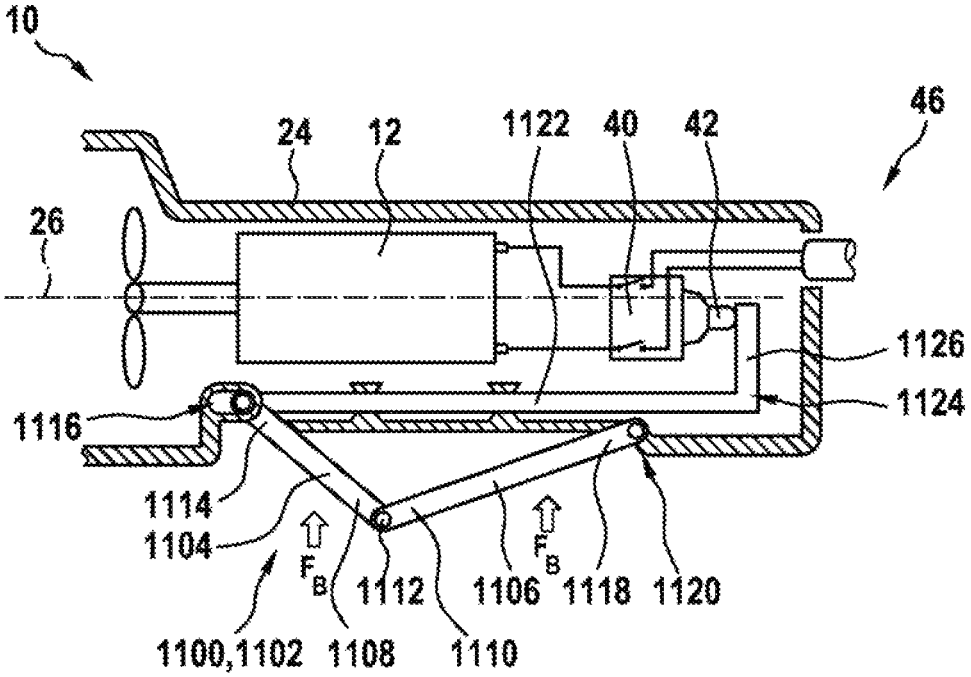
FIG. 22 shows an eleventh embodiment of an operating part, usable with the electric power tool from FIG. 1, in a switched-off state of the electric on/off switch.

FIG. 22 illustrates an eleventh embodiment of a double-lever-like operating part 1100, which is preferably again formed with a toggle pawl 1102. The latter preferably comprises a first and a second arm 1104, 1106, the ends 1108, 1110 of which that face one another are connected together in an articulated manner at a central joint 1112. A further end 1114, directed away from the central joint 1112, of the first arm 1104 is received in a displaceable and pivotable manner in a common coupling joint 1116 on the tool housing 24. A further end 1118, directed away from the central joint 1112, of the second arm 1106 is received in a rotatable and pivotable manner at a rotary joint 1120. A first leg 1122 of an L-shaped or angular sliding switch 1124 is preferably received in the tool housing 24 so as to be displaceable longitudinally or parallel to the longitudinal axis 26. A second leg 1126 of the sliding switch 1124 that has a reduced length compared to the first leg 1122 and extends transversely thereto bears on the actuating member 42 of the electric on/off switch 40.

In the switched-off state in FIG. 22, the operating part 1100 or the toggle pawl 1102 is unloaded and the electric on/off switch 40 is in the switched-off state, such that the drive motor 12 of the electric power tool 10 is likewise switched off. On account of the force applied by the actuating member 42, axially pretensioned by spring loading, of the electric on/off switch 40, the two arms 1104, 1106 of the toggle pawl 1102 are in a position raised from the tool housing 24. If the actuating force $F_B$ now acts on the toggle pawl 1102 at any desired point along the longitudinal extent thereof, the sliding switch 1124 is pushed away from the rear end portion 46 of the tool housing 24 and the actuating member 42 is depressed and the latter is set into the switched-on state (not illustrated), in which the drive motor 12 of the electric power tool 10 is powered. If the operating part 1100 is released, the operations are reversed and the electric on/off switch 40 reaches the switched-off state in FIG. 22.

Figure 23:
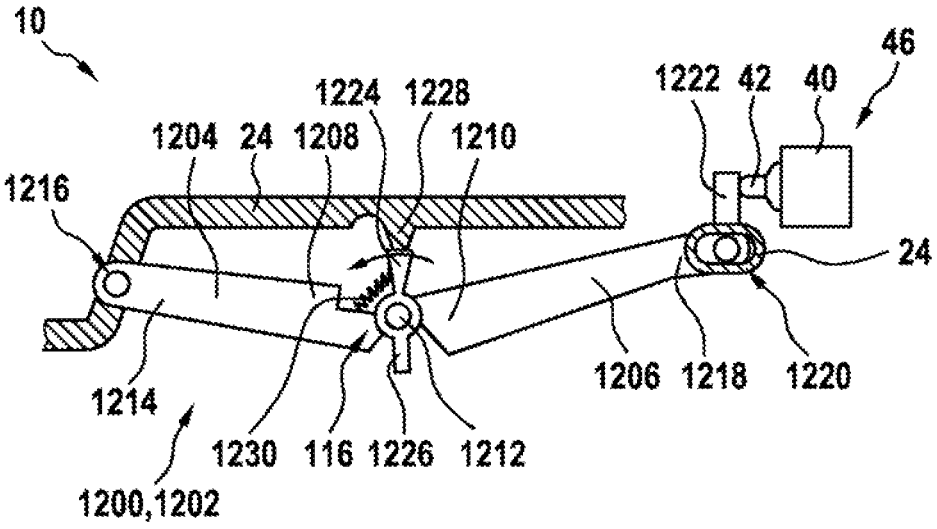
FIGS. 23, 24 show a twelfth embodiment of an operating part, usable with the electric power tool from FIG. 1, in a switched-off and switched-on state of the electric on/off switch.
Figure 24:
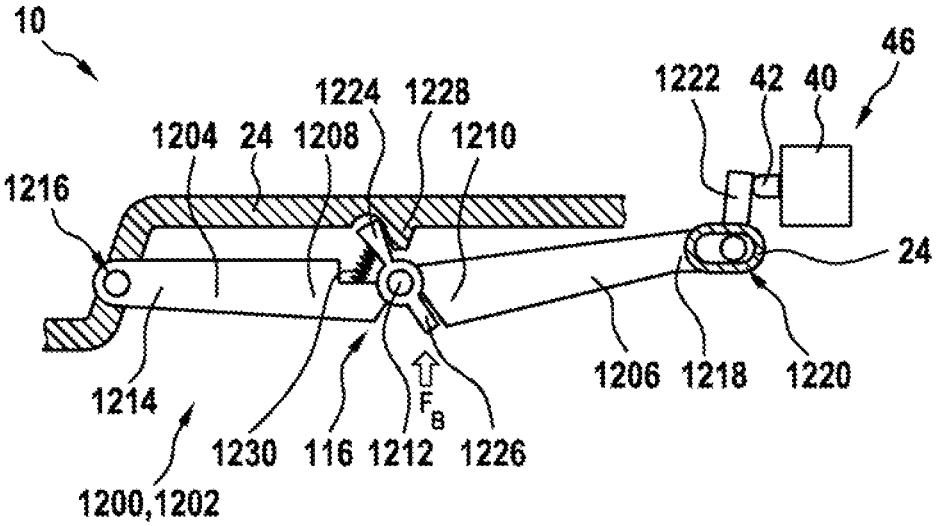

FIG. 23 and FIG. 24—to which reference is also made in the rest of the description—show a twelfth embodiment of a preferably double-lever-like operating part 1200, which is likewise formed with a toggle pawl 1202. The latter preferably comprises a first and a second arm 1204, 1206, the ends 1208, 1210 of which that face one another are connected together in an articulated manner at a central joint 1212. Another end 1214, directed away from the central joint 1212, of the first arm 1204 is received in a pivotable or rotatable manner in a rotary joint 1216 on the tool housing 24. A further end 1218, directed away from the central joint 1212, of the second arm 1206 is connected to the tool housing 24 in a displaceable and pivotable manner in a coupling joint 1220. An actuating arm 1222 is formed at the end 1218 of the second arm 1206 at an obtuse angle to the latter, said actuating arm 1222 bearing on the actuating member 42 of the electric on/off switch 40. The electric on/off switch 40 is in this case positioned in the tool housing 24 in a mirror-inverted manner compared with the embodiments in FIG. 20 to FIG. 22.

The locking member 116, which is mounted in a pivotable manner by way of example in the central joint 1212, here, preferably comprises a blocking member 1224 and an actuating member 1226 arranged diametrically opposite the latter. In the locking state in FIG. 23, the blocking member 1224 bears on a radially outwardly directed protrusion 1228 of the tool housing 24, such that it is not possible to actuate the operating part 1200 and thus accidentally switch on the drive motor 12 of the electric power tool 10. The locking member 116 is pretensioned by means of a spring 1230 such that it pivots automatically back into the position in FIG. 23 after the operating part 1200 has been released.

In order to lift the locking state and to reach the unlocking state of the locking member 116, the locking member 116 has to be pivoted counter to the force applied by the spring 1230 in a direction indicated by an arrow. With an actuating force $F_B$ simultaneously acting on the operating part 1200, the toggle pawl 1202 reaches its virtually completely extended position in FIG. 24, in which the arms 1204, 1206 bear in a substantially parallel manner on the underside of the tool housing 24, wherein the blocking member 1224 comes laterally into abutment against the protrusion 1228 and the locking member 116 no longer opposes the movement, directed radially inward with respect to the tool housing 24, of the toggle pawl 1202. In this case, the actuating arm 1222 is displaced in the direction of the rear end portion 46 of the tool housing 24 and depresses the actuating member 42 of the electric on/off switch 40 such that—as is apparent from FIG. 24—the latter reaches the switched-on state and the drive motor 12 of the electric power tool 10 is switched on. When the operating part 1200 is released or when there is no actuating force $F_B$, the movement operations are reversed and the toggle pawl 1202 automatically returns, on account of the force applied by the actuating member 42, axially pretensioned by spring loading, into the position, raised from the tool housing 24, in FIG. 23, in which the electric on/off switch 40 is in the switched-off state and the drive motor 12 of the electric power tool 10 is not powered.

The invention claimed is:

1. An electric power tool, comprising:

a tool receptacle; and a tool housing in which a drive motor configured to drive the tool receptacle is arranged, wherein:

the drive motor is configured to be switched on and off via an electric on/off switch, an operating part for at least indirectly actuating the on/off switch is arranged on the tool housing, the operating part at least regionally extends at least approximately parallel to a longitudinal axis of the tool housing, the operating part is configured as a lever and is arranged pivotably on the tool housing, an actuating member of the electric on/off switch is displaceable at least approximately parallel to the longitudinal axis by an actuating force that acts on the operating part at least approximately perpendicularly to the longitudinal axis, the drive motor is configured to be switched on when the actuating force acts on the operating part counter to a restoring force of the electric on/off switch, the drive motor is configured to be switched off automatically when the operating part is released by a user, due at least in part to the restoring force of the electric on/off switch, the operating part includes a two-armed pawl, which is received in a pivotable manner at a pivot point on the tool housing, the two-armed pawl having a first arm on a first side of the pivot point and a second arm on a second side of the pivot point, the actuating member of the electric on/off switch is configured to be actuated by a first arm of an angle lever arranged pivotably in the tool housing, and a second arm of the angle lever bears on the second arm of the two-armed pawl is connected to the second arm of the two-armed pawl by a coupling joint.

2. The electric power tool as claimed in claim 1, further comprising:

a mechanical locking member configured to avoid accidental actuation by a user, the mechanical locking member assigned to the operating part.

3. The electric power tool as claimed in claim 1, wherein the operating part is pretensioned with respect to the tool housing by a return spring.

4. The electric power tool as claimed in claim 1, wherein the operating part includes a toggle pawl.

5. The electric power tool as claimed in claim 1, wherein the two-armed pawl is pivotably arranged at a first pivot point on the tool housing and the angle lever is pivotably arranged at a second pivot point on the tool housing.

6. An electric power tool, comprising:

a tool receptacle; and a tool housing in which a drive motor configured to drive the tool receptacle is arranged, wherein:

the drive motor is configured to be switched on and off via an electric on/off switch, an operating part for at least indirectly actuating the on/off switch is arranged on the tool housing, the operating part at least regionally extends at least approximately parallel to a longitudinal axis of the tool housing, the operating part is configured as a lever and is arranged pivotably on the tool housing, an actuating member of the electric on/off switch is displaceable at least approximately parallel to the longitudinal axis by an actuating force that acts on the operating part at least approximately perpendicularly to the longitudinal axis, the drive motor is configured to be switched on when the actuating force acts on the operating part counter to a restoring force of the electric on/off switch, the drive motor is configured to be switched off automatically when the operating part is released by a user, due at least in part to the restoring force of the electric on/off switch, the actuating member of the electric on/off switch is configured to be actuated by a first transverse arm of a one-armed lever arranged pivotably in the tool housing, and the first transverse arm of said one-armed lever is connected at its end to a second transverse arm of the second arm of the two-armed pawl via a coupling joint.

7. An electric power tool, comprising:

a tool receptacle; and a tool housing in which a drive motor configured to drive the tool receptacle is arranged, wherein:

the drive motor is configured to be switched on and off via an electric on/off switch, an operating part for at least indirectly actuating the on/off switch is arranged on the tool housing, the operating part at least regionally extends at least approximately parallel to a longitudinal axis of the tool housing, the operating part is configured as a lever and is arranged pivotably on the tool housing, an actuating member of the electric on/off switch is displaceable at least approximately parallel to the longitudinal axis by an actuating force that acts on the operating part at least approximately perpendicularly to the longitudinal axis, the drive motor is configured to be switched on when the actuating force acts on the operating part counter to a restoring force of the electric on/off switch, the drive motor is configured to be switched off automatically when the operating part is released by a user, due at least in part to the restoring force of the electric on/off switch, the actuating member of the electric on/off switch is configured to be actuated by a toggle lever arranged in the tool housing, and a central joint of said toggle lever is connected to an end-side transverse arm of the second arm of the two-armed pawl via a coupling joint.

8. An electric power tool, comprising:

a tool receptacle; and a tool housing in which a drive motor configured to drive the tool receptacle is arranged, wherein:

the drive motor is configured to be switched on and off via an electric on/off switch, an operating part for at least indirectly actuating the on/off switch is arranged on the tool housing, the operating part at least regionally extends at least approximately parallel to a longitudinal axis of the tool housing, the operating part is configured as a lever and is arranged pivotably on the tool housing, an actuating member of the electric on/off switch is displaceable at least approximately parallel to the longitudinal axis by an actuating force that acts on the operating part at least approximately perpendicularly to the longitudinal axis, the drive motor is configured to be switched on when the actuating force acts on the operating part counter to a restoring force of the electric on/off switch, the drive motor is configured to be switched off automatically when the operating part is released by a user, due at least in part to the restoring force of the electric on/off switch, the actuating member of the electric on/off switch is configured to be actuated with aid of a control cam bearing on the actuating member, and the control cam is formed on a transverse arm of the second arm of the two-armed pawl.

9. An electric power tool, comprising:

a tool receptacle; and a tool housing in which a drive motor configured to drive the tool receptacle is arranged, wherein:

the drive motor is configured to be switched on and off via an electric on/off switch, an operating part for at least indirectly actuating the on/off switch is arranged on the tool housing, the operating part at least regionally extends at least approximately parallel to a longitudinal axis of the tool housing, the operating part is configured as a lever and is arranged pivotably on the tool housing, an actuating member of the electric on/off switch is displaceable at least approximately parallel to the longitudinal axis by an actuating force that acts on the operating part at least approximately perpendicularly to the longitudinal axis, the drive motor is configured to be switched on when the actuating force acts on the operating part counter to a restoring force of the electric on/off switch, the drive motor is configured to be switched off automatically when the operating part is released by a user, due at least in part to the restoring force of the electric on/off switch, the actuating member of the electric on/off switch is configured to be actuated by a first control cam and a second control cam, the first and second control cams are formed in a mirror-symmetrical manner with respect to one another on a transverse arm formed perpendicularly on the second arm of the two-armed pawl, and in the event of an actuating force acting on one of the first arm and the second arm of the two-armed pawl, the first and second control cams each bear alternately on the actuating member.

10. An electric power tool, comprising:

a tool receptacle; and a tool housing in which a drive motor configured to drive the tool receptacle is arranged, wherein:

the drive motor is configured to be switched on and off via an electric on/off switch, an operating part for at least indirectly actuating the on/off switch is arranged on the tool housing, the operating part at least regionally extends at least approximately parallel to a longitudinal axis of the tool housing, the operating part is configured as a lever and is arranged pivotably on the tool housing, an actuating member of the electric on/off switch is displaceable at least approximately parallel to the longitudinal axis by an actuating force that acts on the operating part at least approximately perpendicularly to the longitudinal axis, the drive motor is configured to be switched on when the actuating force acts on the operating part counter to a restoring force of the electric on/off switch, the drive motor is configured to be switched off automatically when the operating part is released by a user, due at least in part to the restoring force of the electric on/off switch, the operating part includes a one-armed pawl received in a pivotable manner at a first pivot point on the tool housing, the pivot point is arranged in a rear end portion, directed away from the tool receptacle, of the tool housing, the actuating member of the electric on/off switch is configured to bear on a first arm of a two-armed lever arranged pivotably in the tool housing at a second pivot point on the tool housing, and a second arm of the lever is configured to be actuated by a protrusion on the one-armed pawl.

11. The electric power tool as claimed in claim 10, further comprising:

a blocking member pivotably arranged on the one-armed pawl and configured to bear against the tool housing so as to prevent pivoting of the one-armed pawl.

12. The electric power tool as claimed in claim 10, wherein the protrusion is arranged on the one-armed pawl entirely between the first pivot point and a first end of the one-armed pawl that is opposite the first pivot point.

13. The electric power tool as claimed in claim 12, wherein the protrusion projects towards an underside of the tool housing and is configured to move towards the tool housing when the actuating force acts on the operating part.

14. The electric power tool as claimed in claim 12, wherein the first pivot point is located at a second end of the one-armed pawl that is opposite the first end.

15. An electric power tool, comprising:

a tool receptacle; and a tool housing in which a drive motor configured to drive the tool receptacle is arranged, wherein:

the drive motor is configured to be switched on and off via an electric on/off switch, an operating part for at least indirectly actuating the on/off switch is arranged on the tool housing, the operating part at least regionally extends at least approximately parallel to a longitudinal axis of the tool housing, the operating part is configured as a lever and is arranged pivotably on the tool housing, an actuating member of the electric on/off switch is displaceable at least approximately parallel to the longitudinal axis by an actuating force that acts on the operating part at least approximately perpendicularly to the longitudinal axis, the drive motor is configured to be switched on when the actuating force acts on the operating part counter to a restoring force of the electric on/off switch, the drive motor is configured to be switched off automatically when the operating part is released by a user, due at least in part to the restoring force of the electric on/off switch, the operating part includes a one-armed pawl received in a pivotable manner at a pivot point on the tool housing, the pivot point is arranged in a rear end portion, directed away from the tool receptacle, of the tool housing, the actuating member of the electric on/off switch is configured to be actuated by a two-armed lever, and the two-armed lever is articulated, by a coupling rod, on a protrusion formed substantially perpendicularly to a lever axis of the one-armed pawl.

16. An electric power tool, comprising:

a tool receptacle; and a tool housing in which a drive motor configured to drive the tool receptacle is arranged, wherein:

the drive motor is configured to be switched on and off via an electric on/off switch, an operating part for at least indirectly actuating the on/off switch is arranged on the tool housing, the operating part at least regionally extends at least approximately parallel to a longitudinal axis of the tool housing, the operating part is configured as a lever and is arranged pivotably on the tool housing, an actuating member of the electric on/off switch is displaceable at least approximately parallel to the longitudinal axis by an actuating force that acts on the operating part at least approximately perpendicularly to the longitudinal axis, the drive motor is configured to be switched on when the actuating force acts on the operating part counter to a restoring force of the electric on/off switch, the drive motor is configured to be switched off automatically when the operating part is released by a user, due at least in part to the restoring force of the electric on/off switch, the operating part includes a one-armed pawl received in a pivotable manner at a pivot point on the tool housing, the pivot point is arranged in a rear end portion, directed away from the tool receptacle, of the tool housing, the actuating member of the electric on/off switch is configured to be actuated by way of an at least regionally bow-shaped sliding switch that is received in the tool housing so as to be displaceable parallel to the longitudinal axis of the latter, a first arm of the sliding switch is connected to the one-armed pawl via a coupling joint having a protrusion directed toward the tool housing, and a second arm of the sliding switch is configured to bear on the actuating member of the electric on/off switch.

* * * * *